US005688425A

United States Patent [19]

Yamamoto et al.

[11] Patent Number: 5,688,425

[45] Date of Patent: Nov. 18, 1997

[54] SUBMERGED NOZZLE CHANGING APPARATUS

[75] Inventors: Kenji Yamamoto, Sanyo-cho; Tadao Taniguchi, Bizen, both of Japan

[73] Assignee: Shinagawa Shirorenga Kabushiki Kaisha, Tokyo, Japan

[21] Appl. No.: 583,091

[22] PCT Filed: May 6, 1994

[86] PCT No.: PCT/JP94/00742

§ 371 Date: Jan. 3, 1996

§ 102(e) Date: Jan. 3, 1996

[87] PCT Pub. No.: WO95/30501

PCT Pub. Date: Nov. 16, 1995

[51] Int. Cl.[6] ..... B22D 41/56

[52] U.S. Cl. ..... 222/606; 266/DIG. 1; 222/591

[58] Field of Search ..... 222/591, 597, 222/606, 607; 266/236, DIG. 1

[56] References Cited

U.S. PATENT DOCUMENTS 4,220,271 9/1980 Szadkowski ..... 222/607
4,854,488 8/1989 Trenkle et al. ..... 222/607
5,180,536 1/1993 Bruckner et al. ..... 222/606
5,238,158 8/1993 Yamamoto et al. ..... 222/607

FOREIGN PATENT DOCUMENTS 04033771A 2/1992 Japan .
WO/9200822 1/1992 WIPO .

*Primary Examiner*—Scott Kastler
*Attorney, Agent, or Firm*—Koda and Androlia

[57] ABSTRACT

A submerged nozzle changing apparatus comprises: a slide valve device (32) for controlling the rate of discharge of a molten metal from a molten metal container (30) a nozzle holding cylinder actuator (42) supported in a vertical position under the slide valve device; and a guide arm unit (44) supported on the piston rod (43) of the nozzle holding cylinder actuator in a horizontal position. The guide arm unit (44) has a pair of parallel guide rails (45) provided in their inner surfaces facing each other with guide grooves (46) having open opposite ends and a length long enough to hold at least three nozzle cases (48) fitted on the upper parts of submerged nozzles (47). A new submerged nozzle is supported on the guide arm unit with portions of a nozzle case fitted on the upper part thereof engaged in the guide grooves of the pair of guide rails and is moved to a nozzle setting position by a nozzle changing cylinder actuator (56).

8 Claims, 9 Drawing Sheets

SUBMERGED NOZZLE CHANGING APPARATUS

TECHNICAL FIELD

The present invention relates to a submerged nozzle changing apparatus for changing a submerged nozzle through which a molten metal is taken out from a molten metal container.

BACKGROUND ART

As shown, by way of example, in FIG. 11, a molten metal container 1, such as a tundish or a ladle, has a bottom wall 2 provided with a well block 3 having a tap hole 4, and an insert nozzle 5 is inserted in the tap hole 4. A slide valve device 6 having a bottom plate 7 provided with a hole 8 is attached to the lower surface of the tundish 1 so as to support the insert nozzle 5 on the upper surface of the periphery of the hole 8 of the bottom plate 7. Further, a submerged nozzle 9 is held at its upper part in a suspended position under the slide valve device 6 by a nozzle case 10, and the nozzle case 10 is held by a submerged nozzle holding device 11.

In a continuous casting installation as shown in FIG. 12, the lower part of the submerged nozzle 9 is submerged in a water-cooled mold 12, a molten metal is poured into the mold 12 continuously through outlet openings 9*a* formed in the circumference of the lower part of the submerged nozzle 9. The circumferential part of the molten metal 13 is cooled in the mold 12, and then the molten metal 13 is discharged from the lower end of the mold 12 and delivered to the next process.

The slide valve device 6 has a slide plate 16 provided with a hole 17 and connected to the piston rod 15 of a hydraulic cylinder actuator 14. The hydraulic cylinder actuator 14 slides the slide plate 16 horizontally between a position where the hole 17 of the slide plate 16 coincides with the hole 8 of the bottom plate 7 and a position where the hole 17 of the slide plate 16 is positioned away from the hole 8 of the bottom plate 7, to regulate the discharge rate of the molten metal.

The nozzle case 10 houses therein a top expanded part of the submerged nozzle 9 and the upper end surface of the submerged nozzle 9 is closely joined through a seal packing, not shown, to the lower end surface of a chute nozzle 18. Mounting pins 19 project diametrically opposite to each other from the outer surface of the nozzle case 10.

Since the lower part of the submerged nozzle 9 is submerged continuously as mentioned above in and washed by the molten metal, the lower part of the submerged nozzle 9 wears out and the submerged nozzle must be replaced with a new submerged nozzle 9 at an appropriate time.

Accordingly, nozzle holding device 11 capable of changing the submerged nozzle 9 as quickly as possible have been used. In the conventional nozzle holding device 11 shown in FIG. 11, a pneumatic cylinder actuator 21 is attached to the lower surface of the slide valve device 6 with its piston rod 20 projecting downward, and a support arm 22 is fixed to the piston rod 20 of the pneumatic cylinder actuator 21. The support arm 22 is provided in its free end with recesses 23 for receiving the mounting pins 19 of the nozzle case 10 therein to support the nozzle case 10. After the mounting pins 19 of the submerged nozzle 9 have been seated in the recesses 23, the piston rod 20 of the pneumatic cylinder actuator 21 is retracted to press the upper end surface of the submerged nozzle 9 through a sealing packing against the lower surface of the periphery of the hole 17 of the slide plate 16 or, when the slide valve device 6 is provided with the chute nozzle 18, against the lower surface of the chute nozzle 18 and to hold the submerged nozzle 9 fixedly in place. The means for fixedly holding the submerged nozzle 9 may be a lever or toggle mechanism.

When replacing the submerged nozzle 9 with a new one using this nozzle holding device, the slide plate 16 of the slide valve device 6 is first driven for sliding to close the slide valve device 6, the piston rod 20 of the pneumatic cylinder actuator 21 is then extended to lower the support arm 22 after lifting up the tundish 1, and the submerged nozzle 9 is dismounted by hand. Thereafter, the lower end surface of the chute nozzle 18 is cleaned; a new submerged nozzle 9 and a seal packing are set on the support arm 22; the piston rod 20 of the pneumatic cylinder actuator 21 is retracted to raise the submerged nozzle 9 and; at the same time, the tundish 1 is lowered. Then the slide valve device 6 is opened. This submerged nozzle changing procedure takes at least 60 to 90 sec.

Consequently, there arises serious problems that the surface of the molten metal 13 contained in the mold 12 solidifies while the submerged nozzle 9 is being changed, and that a possibility of a machine stop slab in the molten metal 13 being scrapped increases with resultant reduction of the yield.

Although the reduction of the duration of interruption of discharging the molten metal 13 is desired, only a limited reduction in the time for dismounting the used submerged nozzle 9 and inserting a new submerged nozzle 9 is possible. Even if the operation for lifting up and lowering the tundish 1 is omitted with an intention to save the time necessary for lifting and lowering the tundish 1, only a narrow space is available under the slide valve device 6, and therefore the replacement of the used submerged nozzle 9 with a new one in the narrow space under the slide valve device 6 requires much time and labor. For this reason quick change of the submerged nozzle 9 is difficult.

The submerged nozzle is dismounted from and mounted on the slide valve device 6 by manual work of operators. Since the submerged nozzle is formed of blocks and is heavy, the manual work for mounting and dismounting the submerged nozzle is not easy, and is undesirable in view of working conditions, because the submerged nozzle mounting and dismounting work needs to be carried out in a very hot, harsh environment around the slide valve device 6.

A technique proposed in U.S. Pat. No. 4,669,528 to facilitate the submerged nozzle changing work employs a fixed plate provided at is lower part with a slide mechanism. This technique uses a special submerged nozzle provided on its upper part with a flat block housed in a casing formed of a thin steel plate. The submerged nozzle is supported at a front and a back part of the lower surface of the casing, and is urged upward with springs. The submerged nozzle is slide along a guide rail formed in a shape capable of pressing the upper surface of the flat block of the submerged nozzle against the lower surface of the fixed plate.

When changing the submerged nozzle during continuous casting, a new submerged nozzle is set on the slide mechanism, a submerged nozzle pushing cylinder is set, and an insert nozzle is closed by a stopper. Further, the submerged nozzle is pushed into the submerged nozzle pushing cylinder, the stopper is moved to an open position, and then the used submerged nozzle is taken out. Time necessary for carrying out those submerged nozzle changing steps is about 10 to about 15 sec. Thus, the previously proposed submerged nozzle changing technique is capable of changing the submerged nozzle more quickly than the aforesaid conventional submerged nozzle changing technique.

However, since this device must use the special submerged nozzle provided on its upper part with the flat block and housed in the housing, the cost of this submerged nozzle is about 1.5 times as high as that of the conventional submerged nozzle, increases the running costs, and the flat block is liable to be deformed in a curve because the casing of the submerged nozzle is pressed at the two parts in the lower surface thereof. Consequently, gaps are formed between the mating surfaces of the fixed plate and the flat block, entailing abnormal erosion and deterioration in the quality of the steel due to the suction of air in the gaps. If the flat block is cracked, the so-called metal penetration, i.e., penetration of the molten metal into cracks, occurs and, in the worst case, the molten metal leaks. Since the discharge of the molten metal is controlled by the stopper, $Al_2O_3$ is liable to deposit on the stopper head, which makes the control of discharge rate difficult.

It is an object of the present invention to provide a submerged nozzle changing apparatus capable of reducing the time of interruption of casting necessary for changing the submerged nozzle to a least possible extent, of increasing the yield by reducing the amount of the molten metal to be scrapped and of reducing manual work in a harsh environment.

The present invention does not need the use of a submerged nozzle of a special construction and enables the use of an inexpensive submerged nozzle. Furthermore, the present invention holds the upper part of a submerged nozzle along the entire circumference thereof by a nozzle case so that the submerged nozzle may not be deformed and sealing condition may be improved, and enables the quick change of the submerged nozzle even if the discharge rate control mechanism uses a slide valve device.

Another object of the present invention is to provide a submerged nozzle changing apparatus capable of accurately positioning a new submerged nozzle at a nozzle setting position when replacing a used submerged nozzle with the new submerged nozzle and of facilitating the handling of the submerged nozzles.

A further object of the present invention is to provide a submerged nozzle changing apparatus provided with a structure capable of restraining a submerged nozzle turning relative to a nozzle case and of surely positioning the submerged nozzle with its discharge openings opening in predetermined directions.

DISCLOSURE OF THE INVENTION

According to the present invention, a submerged nozzle changing apparatus comprises: a submerged nozzle holding cylinder actuator for holding a submerged nozzle in a vertical position under a slide valve device for controlling the rate of discharge of a molten metal from a molten metal container; and a guide arm unit supported on a piston rod of the cylinder actuator in a horizontal position. The guide arm unit has a pair of parallel guide rails provided in their inner surfaces facing each other with guide grooves having open opposite ends and a length long enough to hold at least three nozzle cases fitted on the upper parts of submerged nozzles, respectively, and a nozzle changing cylinder actuator capable of moving a new submerged nozzle to a nozzle setting position.

In the submerged nozzle changing apparatus, each of the nozzle case fitted on the submerged nozzle may be provided on the lower surfaces of portions thereof fitted in the guide grooves with positioning projections to be fitted in recesses formed in surfaces defining the guide grooves of the guide rail to position the submerged nozzle at the nozzle setting position.

In the submerged nozzle changing apparatus, the nozzle changing cylinder actuator can be retracted from a working position where the nozzle changing cylinder actuator is able to move the submerged nozzle to the nozzle setting position to a standby position where the nozzle changing cylinder actuator does not obstruct an operation for supplying a submerged nozzle.

In the submerged nozzle changing apparatus, the guide rails may be provided at their ejecting ends with stoppers for preventing the submerged nozzle from slipping off the guide rails.

The submerged nozzle changing apparatus may be provided with a detachable nozzle guide for guiding a submerged nozzle onto the guide rails.

BEST MODE FOR CARRYING OUT THE INVENTION

The present invention will be described in detail with reference to the accompanying drawings.

Figure 1:
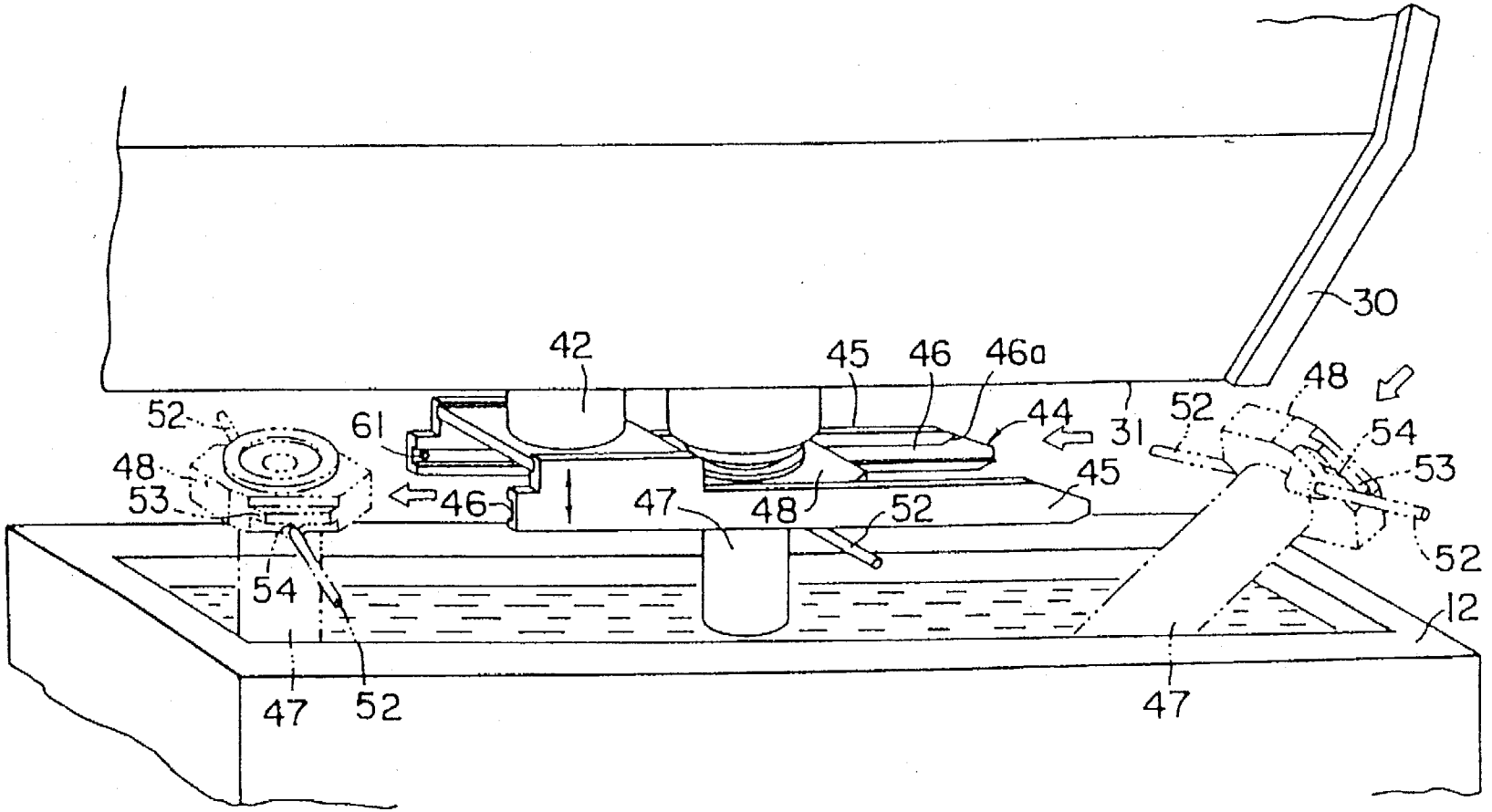
FIG. 1 is a perspective view of a submerged nozzle changing apparatus according to a preferred embodiment of the present invention.
Figure 2:
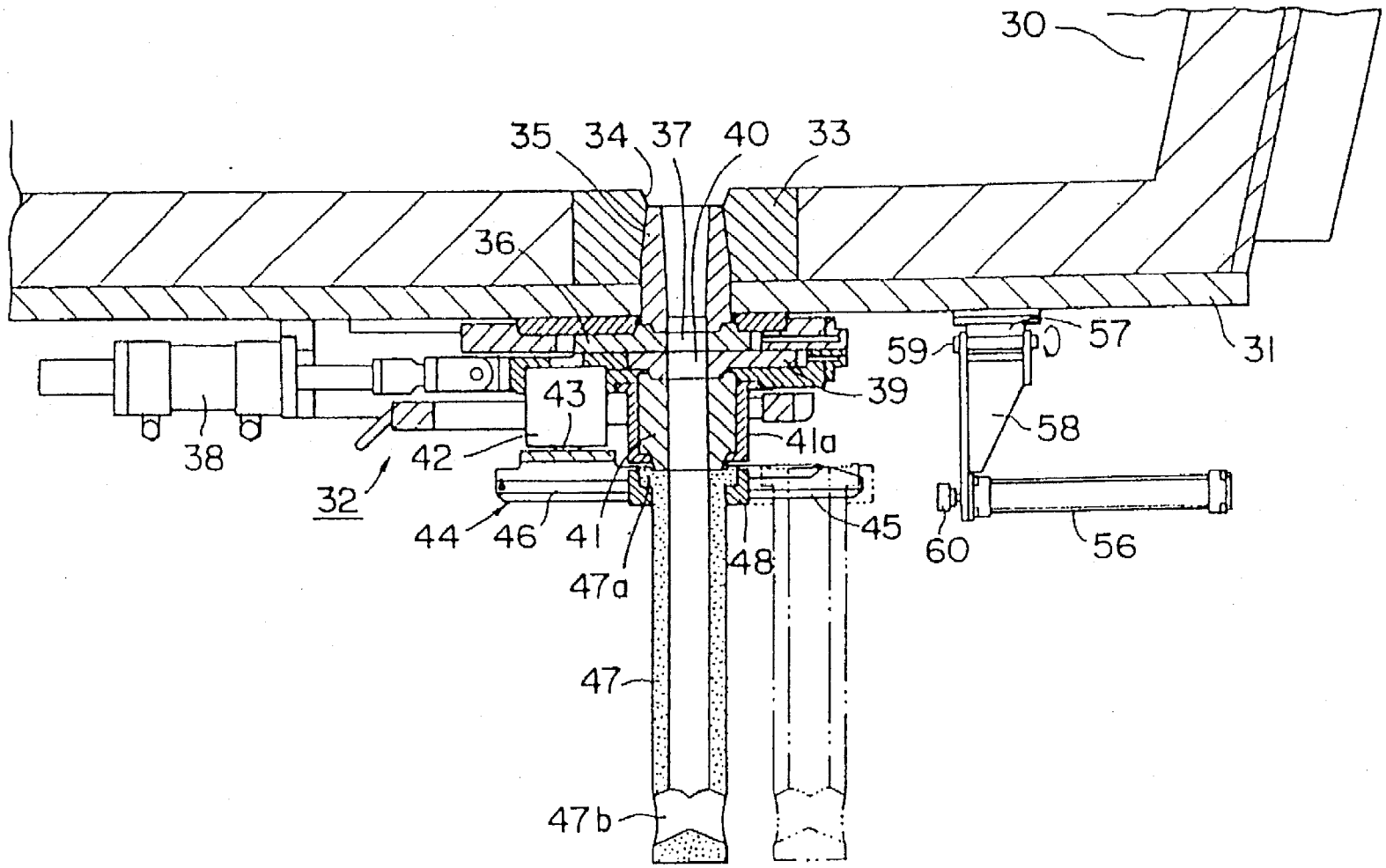
FIG. 2 is a sectional view of the submerged nozzle changing apparatus of FIG. 1.

FIG. 1 shows a perspective view of an essential portion of a submerged nozzle changing apparatus according to a preferred embodiment of the present invention, and in FIG. 2 is shown a sectional view of the portion of the submerged nozzle changing apparatus shown in FIG. 1. As shown in FIGS. 1 and 2, a tundish 30, as an example of a molten metal container, has a bottom wall 31, and a slide valve device 32 is attached to the lower surface of the bottom wall 30.

Figure 11:
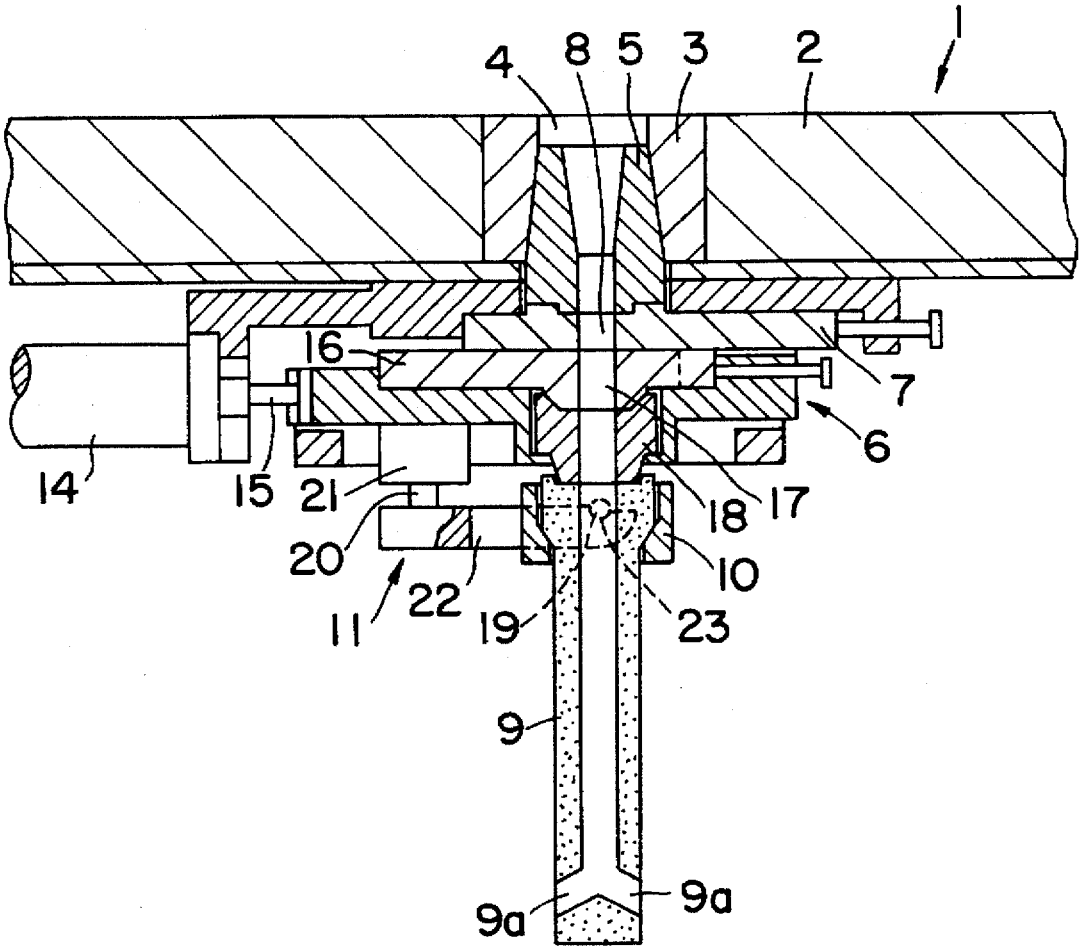
FIG. 11 PRIOR ART
FIG. 11 is a longitudinal sectional view of a submerged nozzle changing apparatus of prior art.
Figure 12:
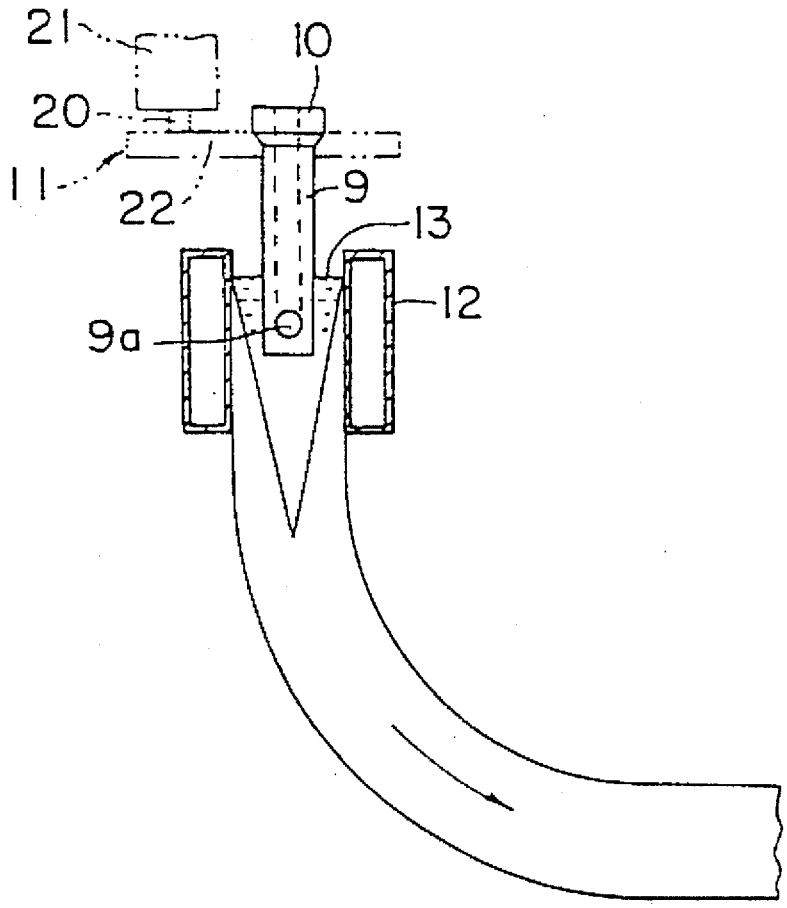
FIG. 12 is a schematic sectional view used for explaining the relation between a continuous casting installation and a submerged nozzle.

The slide valve device 32 is the same in construction as that described with reference to FIG. 11. An insert nozzle 35 is inserted in a tap hole 34 of a well block 33 fitted in an opening formed in the bottom wall 31 of the tundish 30. The slide valve device 32 has a bottom plate 36 provided with a hole 37 and is attached to the lower surface of the tundish 1 so as to support the insert nozzle 35 on the upper surface of the periphery of the hole 37 of the bottom plate 36. The slide valve device 32 has a slide plate 39 provided with a hole 40. The slide plate 39 is moved by a hydraulic cylinder actuator 38 between a position where the hole 40 of the slide plate 39 coincides with the hole 37 of the bottom plate 36 and a position where the hole 40 of the slide plate 39 is positioned away from the hole 37 of the bottom plate 36 to regulate the discharge rate of the molten metal. A chute nozzle 41 contained in a case 41*a* is supported under the hole 40 of the slide plate 39 in the slide valve device 32.

A nozzle holding cylinder actuator (pneumatic or hydraulic) 42 is attached to the lower surface of the slide valve device 32 in a vertical position, and a metallic guide arm unit 44 is fixed at one end thereof to and supported in a horizontal position by the piston rod 43 of the nozzle holding cylinder actuator 42.

The guide arm unit 44 comprises a pair of parallel horizontally extending guide rails 45 provided in their inner surfaces facing each other with longitudinal guide grooves 46 having open opposite ends, respectively. The guide grooves 46 have a length long enough to hold therein at least three nozzle cases 48 fitted on the upper ends of submerged nozzles 47, respectively.

Figure 5:
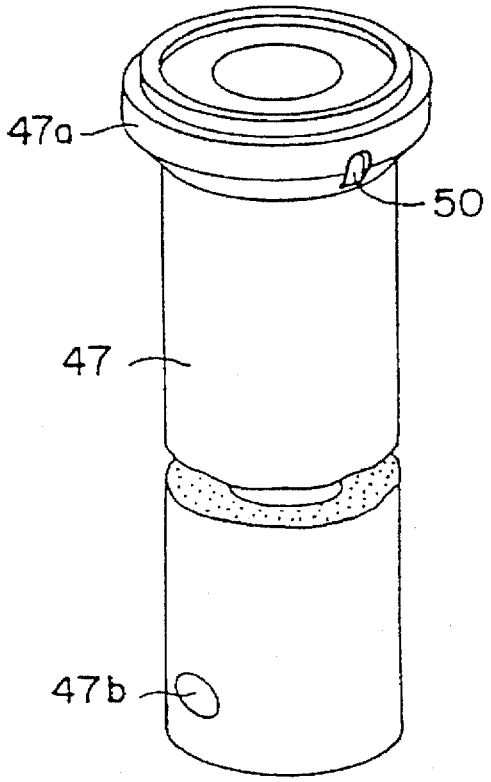
FIG. 5 is a partly cut-away perspective view of a submerged nozzle.
Figure 6:
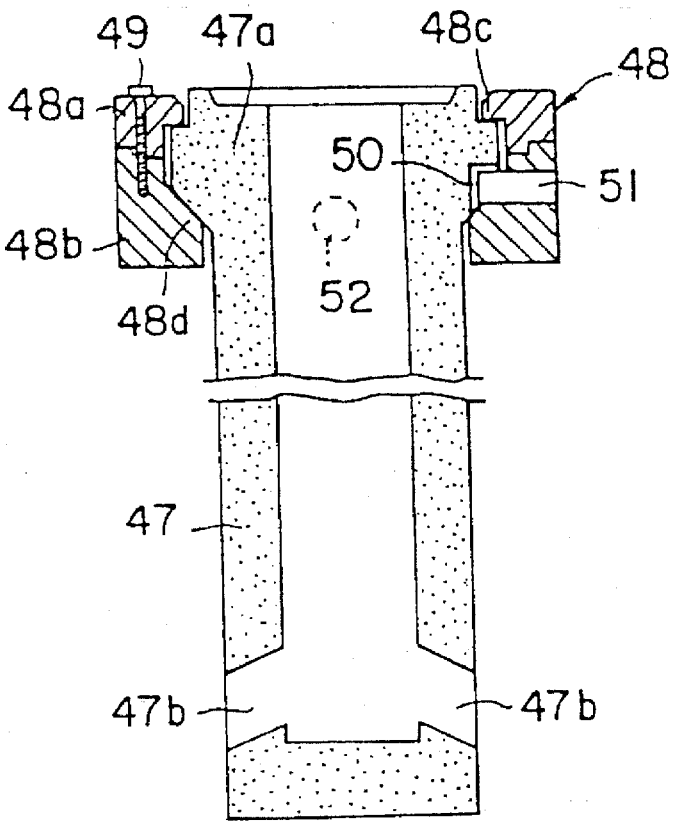
FIG. 6 is a longitudinal sectional view, partly omitted, of a submerged nozzle fitted in a nozzle case.

Each nozzle case 48 is formed of a metal, such as a steel, and fitted on a flange 47*a* formed at the upper part of the submerged nozzle 47 shown in FIG. 5. As shown in a sectional view of FIG. 6, the nozzle case 48 comprises a ring-shaped upper holding block 48*a* having an inner flange 48*c* at its upper end, and a ring-shaped lower holding block 48*b* having an inner flange 48*d* at its lower end. The upper holding block 48*a* and the lower holding block 48*b* are fastened together with bolts 49, i.e., fastening means so as to hold the flange 47*a* of the submerged nozzle 47 with the inner flange 48*c* of the upper holding block 48*a* and the inner flange 48*d* of the lower holding block 48*b* in engagement with the flat upper surface and the tapered lower surface of the flange 47*a* of the submerged nozzle 47, respectively.

Figure 7:
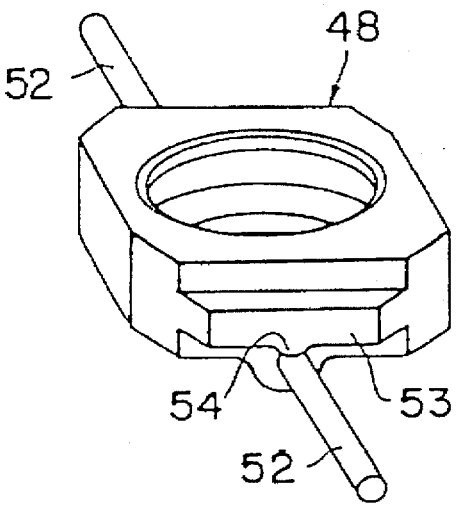
FIG. 7 is a perspective view of another nozzle case.

A vertical groove 50 is formed in the tapered lower surface of the flange 47*a*, and the tip of a positioning pin 51 penetrating the lower holding block 48*b* is fitted in the groove 50 to position the nozzle case 48 relative to the submerged nozzle 47 so that the outlet openings 47*b* of the submerged nozzle 47 extend at right angles to the directions of extension of support pins 52 projecting in diametrically opposite directions from the outer surface of the nozzle case 48 to support the nozzle case 48 when setting the submerged nozzle 47 in place and when removing the same. The vertical groove 50 of the submerged nozzle 47 and the positioning pin 51 attached to the nozzle case 48 serve as a positioning means. The nozzle case 48 shown in FIG. 1 has a hexagonal shape in plan view and is provided at positions above the support pins 52 on its two opposite sides with guide tongues 53 to be fitted closely but slidably in the guide grooves 46. The upper edges 46*a* of the inlet ends of the guide grooves 46 are rounded to facilitate insertion of the guide tongues 53 in the guide groove 46. The shape of the nozzle case 48 in plan view need not necessarily be hexagonal, but may be any optional shape, such as an octagonal shape as shown in FIG. 7.

Figure 3:
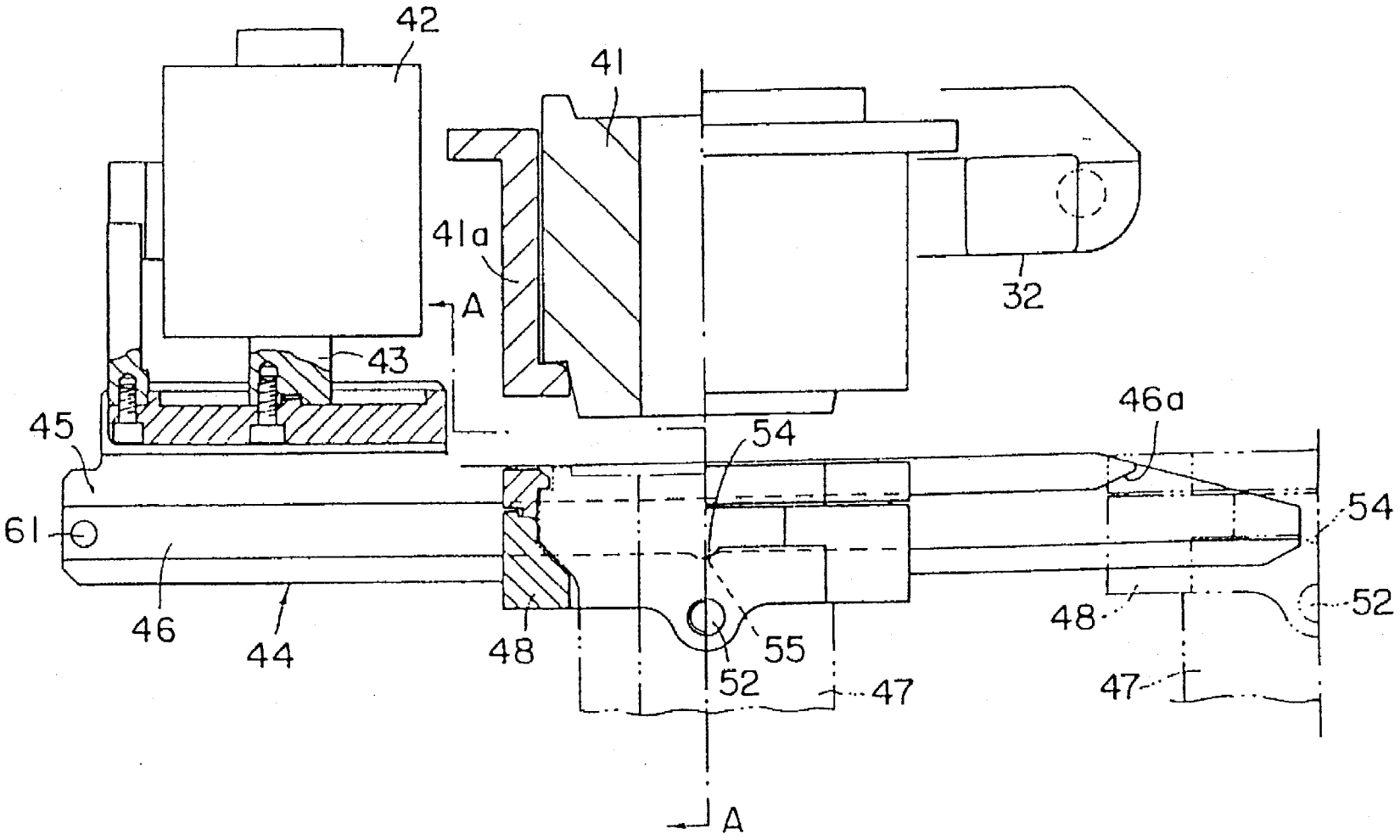
FIG. 3 is an enlarged partly sectional front view of a guide arm unit included in the submerged nozzle changing apparatus of FIG. 1.
Figure 4:
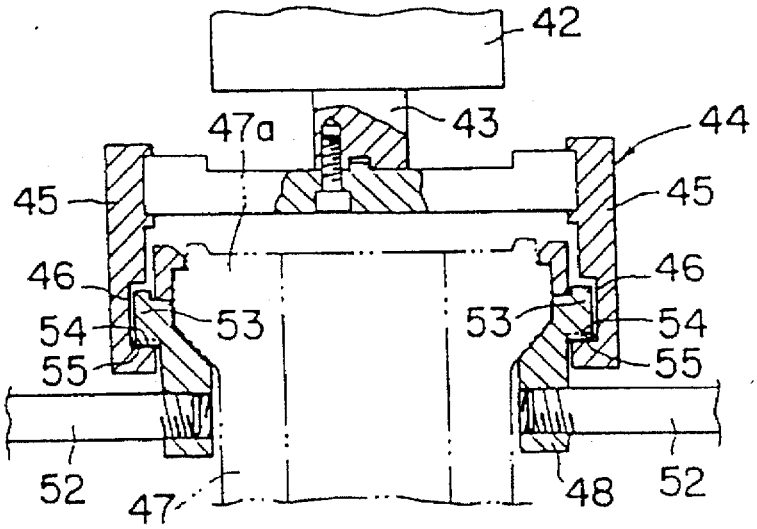
FIG. 4 is a sectional view taken on line A—A in FIG. 3.

Positioning projections 54 are formed on the lower surfaces of the tongues 53 of the nozzle case 48, respectively, and positioning recesses 55 for receiving the projections 54 therein are formed in the lower surfaces of the guide grooves 46, respectively, to position the submerged nozzle 47 at a nozzle setting position as shown in FIG. 3.

A nozzle changing cylinder actuator 56 for moving a new submerged nozzle 47 to a predetermined position is disposed near the submerged nozzle receiving end of the guide arm unit 44. In the embodiment shown in FIG. 2, the base end of a support arm 58 a nozzle changing cylinder actuator support arm 58 is supported pivotally by a shaft 59 on a bracket 57 fixed to the bottom wall 31 of the tundish 30, and the nozzle changing cylinder actuator 56 is attached in a horizontal position to the free end of the support arm 58. When the nozzle changing cylinder actuator 56 is swung or moved downward to a predetermined working position shown in FIG. 2, a pressing member 60 attached to the extremity of the piston rod of the nozzle changing cylinder actuator 56 is positioned so as to be able to push the nozzle case 48 of the submerged nozzle 47 supported on the guide rails 45. The nozzle changing cylinder actuator 56 can be raised or retracted to a standby position near the bottom wall 31 of the tundish 30 so that the nozzle changing cylinder actuator 56 may not interfere with a new submerged nozzle 47 when loading the new submerged nozzle 47 onto the guide rails 45. The nozzle changing cylinder actuator 56 may be removed from the bracket 57 by extracting the shaft 59 from 25 the bracket 57 when the nozzle changing cylinder actuator 56 is not needed.

Stoppers 61 project from the guide grooves 46 at the submerged nozzle ejecting ends, the ends on the left-hand side in FIG. 1, of the guide rails 45 so that the nozzle case 48 fitted on the used submerged nozzle 47 comes into contact therewith to prevent the used submerged nozzle 47 from slipping out of the guide rails 45. The stoppers 61 are retractable or removable to enable the used submerged nozzle 47 to be removed from the guide rails 45 through the submerged nozzle ejecting ends of the guide grooves 46.

Figure 8:
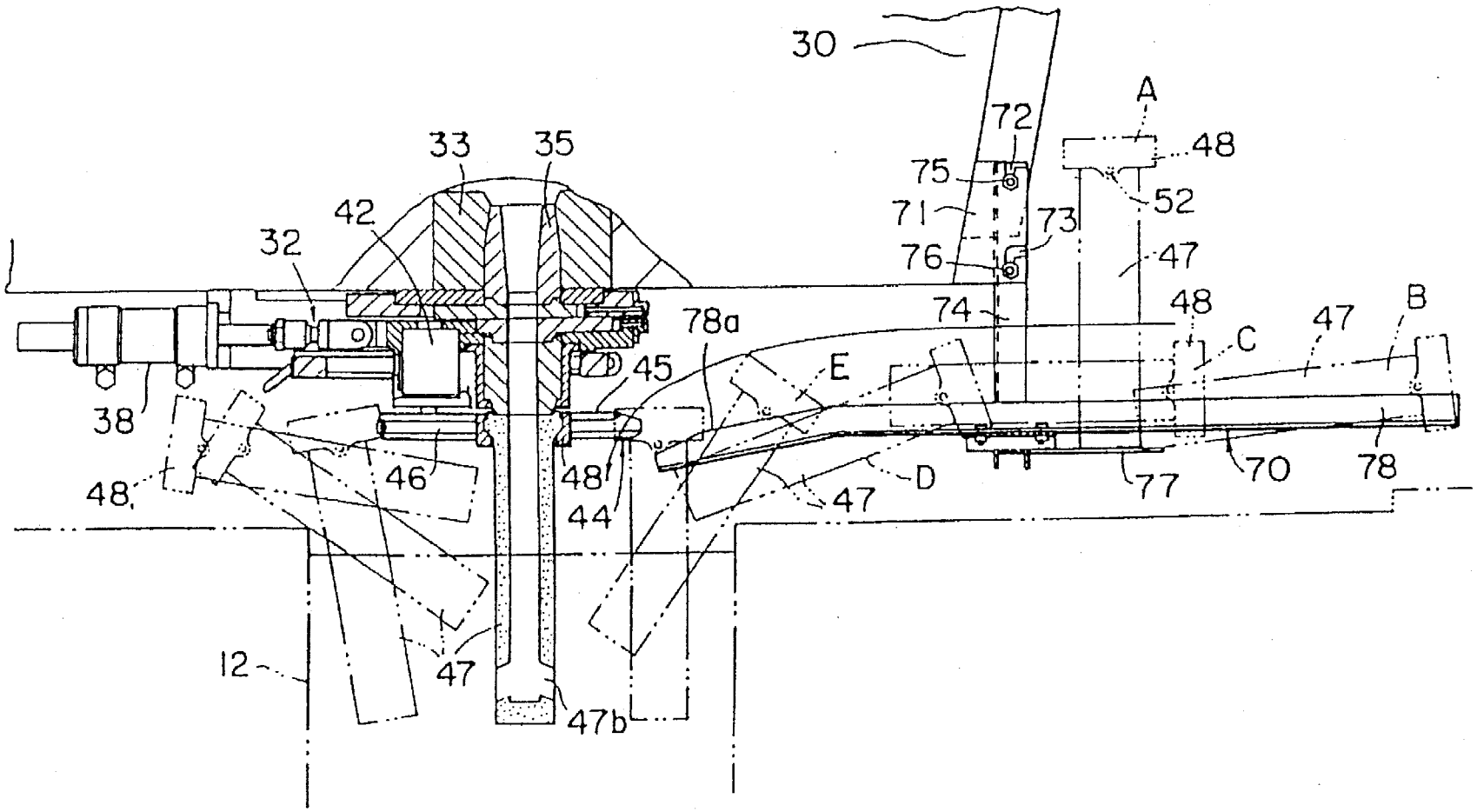
FIG. 8 is a sectional front view of a nozzle guide unit used in the present invention.

A nozzle guide 70 as shown in FIG. 8 is used for loading the new submerged nozzle 47 onto the guide rails 45 of the guide arm unit 44. The nozzle guide 70 is detachably mounted on a support plate 71 fixedly attached to the outer surface of the side wall of the tundish 30 (or the slide valve device 32). The support plate 71 is provided with a slot 72 having an open upper end in the upper end thereof and a bent slot 73 having a horizontal section with an open end and a vertical section in a lower part thereof. Headed pins 75 and 76, such as bolts, attached to a side surface of a support bar 74 for supporting the nozzle guide 70 are removably fitted in the slots 72 and 73, respectively, to support the nozzle guide 70 by the Support plate 71.

A mounting plate 77, such as a steel plate, is joined to the lower end of the support bar 74, and a rail 78, i.e., an angle iron, is fixed to the upper surface Of the mounting plate 77 so as to extend along one side edge of the mounting plate 77. One end portion 78*a* of the rail 78 is declined with a small inclination toward the submerged nozzle receiving end of the guide arm unit 44.

Figure 10:
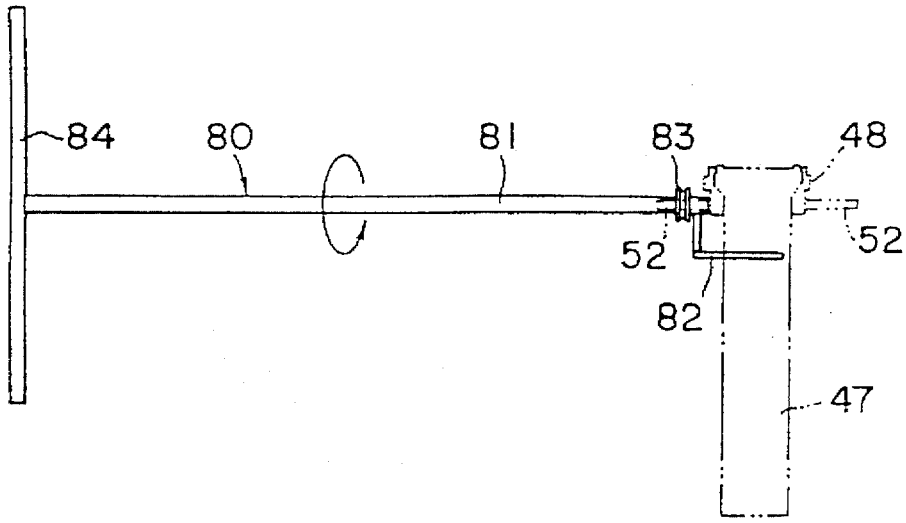
FIG. 10 is a side view of the nozzle handling tool of FIG. 9.

A nozzle handling tool 80 is used in combination with the nozzle guide 70 to facilitate work for handling the submerged nozzle 47. As shown in a side view of FIG. 10, the nozzle handling tool 80 has a shaft 81, such as a pipe, a bifurcate support head 82 having arms capable of receiving the neck of the nozzle case 48 therebetween. The support head 82 has a base end fixedly fitted in the extremity of the shaft 81, a flanged wheel 83 rotatably mounted on the base end of the support head 82, and a handlebar 84 for rotating the shaft 81, fixed to the base end of the shaft 81. The shaft 81 and the handlebar 84 are joined together in a T-shape. The wheel 83 rolls along the rail 78.

Figure 9:
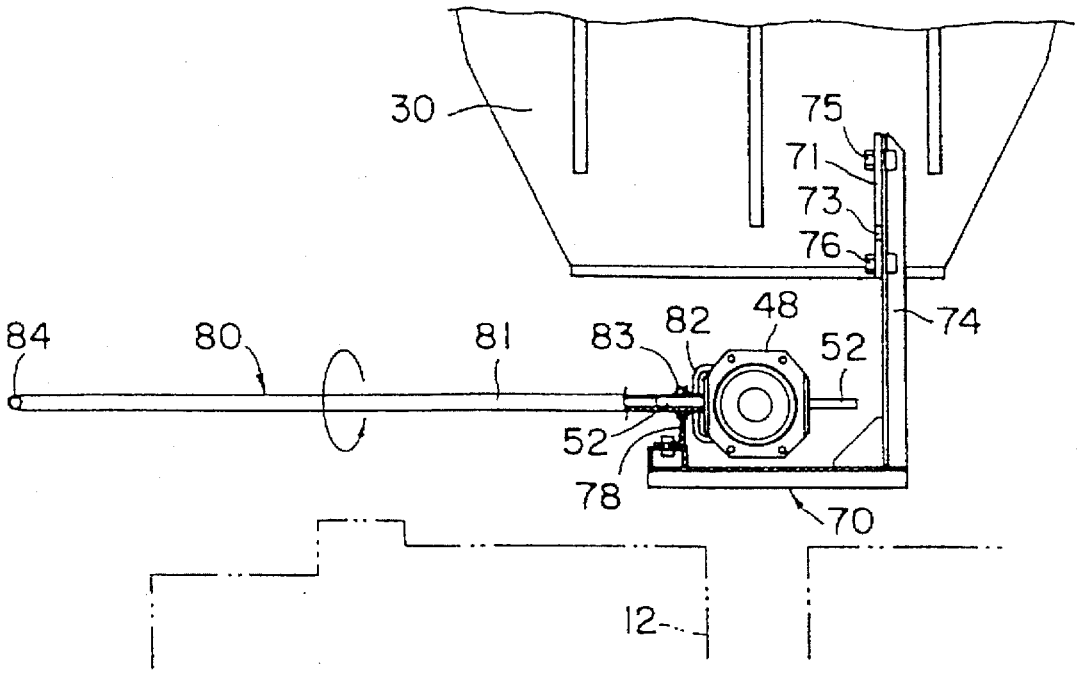
FIG. 9 is a front view of a nozzle handling tool to be used in combination with the nozzle guide of FIG. 8 in a working state.

When setting the new submerged nozzle 47 in place, the nozzle changing cylinder actuator 56 is retracted to the standby position or removed, the pins 75 and 76 of the support bar 74 are fitted in the slots 72 and 73 of the support plate 71 to support the nozzle guide 70 under the tundish 30, and the new submerged nozzle 47 is set on the mounting plate 77 as in an upright position at a position A as shown in FIG. 8. The support head 82 of the nozzle handling tool 80 is then brought into engagement with the neck of the submerged nozzle 47 and the extremity of the shaft 81 of the nozzle handling tool 80 is fitted on the pin 52 of the nozzle case 48. The wheel 83 is placed on the rail 78 as shown in FIG. 9 to lay down the submerged nozzle 47 at a position B.

Subsequently, the submerged nozzle 47 is moved from the position B through a position C to a position D, while the nozzle handling tool 80 is held by the shaft 81 and the handlebar 84. Upon arrival of the submerged nozzle 47 at a position E near the end of the rail 78 where the submerged nozzle 47 can be placed in a mold 12, the submerged nozzle 47 is turned gradually toward an upright position and the submerged nozzle 47 is moved toward the guide arm unit 44 so that the tongues 53 of the nozzle case 48 slide into the guide grooves 46 of the guide rails 45 to set the submerged nozzle 47 on the guide arm unit 44.

A nozzle guide similar to the nozzle guide 70 may be provided near the nozzle ejecting end of the guide arm unit 44 through which the used submerged nozzle 47 is ejected, to facilitate work for removing the used submerged nozzle 47.

A procedure for changing the submerged used nozzle 47 will be described below.

A nozzle case 48 is fitted on a new submerged and the new submerged nozzle 47 is preheated. The new submerged nozzle 47 is transported along the guide rail 70 or by hand to a position near the guide arm unit 44, and then the tongues 53 of the nozzle case 48 fitted on the new submerged nozzle 47 are engaged in the guide grooves 46 of the guide rails 45 of the guide arm unit 44 in a state as indicated by chain lines in FIG. 2. Then, the nozzle changing cylinder actuator 56 is swung downward or attached to the bracket 57 to position the nozzle changing cylinder actuator 56 at the working position shown in FIG. 2, and the slide plate 39 of the slide valve device 32 is slid by the hydraulic cylinder actuator 38 to move the hole 40 of the slide plate 39 away from a position where the hole 40 coincides with the hole 37 of the bottom plate 36 to close the hole 37 of the bottom plate 36.

Thereafter, the piston rod of the nozzle holding cylinder actuator 42 is extended to lower the guide arm unit 44, a seal packing is put on the top surface of the new submerged nozzle 47, and then the piston rod of the nozzle changing cylinder 56 is extended to push the new submerged nozzle 47 to the nozzle setting position. The used submerged nozzle 47 is pushed by the new submerged nozzle 47 along the guide rails 45 to the left, as viewed in FIG. 2. The used submerged nozzle 47 strikes against the stoppers 61 which prevents the used submerged nozzle 47 from slipping out of the guide rails 45 and, at the same time, the positioning projections 54 of the nozzle case 48 fitted on the new submerged nozzle 47 drop into the positioning recesses 55 formed in the lower surfaces of the guide grooves 46, whereby the new submerged nozzle 47 is positioned correctly at the submerged nozzle setting position.

The, guide arm unit 44 is raised by retracting the piston rod of the nozzle holding cylinder actuator 42 to press the upper end of the new submerged nozzle 47 closely through the seal packing against the lower surface of the chute nozzle 41. Then, the piston rod of the hydraulic cylinder actuator 38 is extended to bring the hole 40 of the slide plate 39 into alignment with the hole 37 of the bottom plate 36, and the molten metal pouring operation is thereby resumed. Then, the stoppers 61 are retracted or removed and the used submerged nozzle 47 is taken out from the guide rail unit 44. Time from a moment when the slide valve device 32 is closed till a moment when the slide valve 32 is opened again is about 10 to about 15 sec.

In this embodiment, the slide valve device 32 is closed by moving the slide plate 39 after the new submerged nozzle 47 has been set on the guide arm unit 44, the guide arm unit 44 is lowered, the new submerged nozzle 47 is set at the nozzle setting position and, at the same time, the used submerged nozzle 47 is pushed toward the ejecting end by pushing the new submerged nozzle 47 by the nozzle changing cylinder actuator 56. Then, the new submerged nozzle 47 can be set at the working position by raising the guide arm unit 44. Thus, time necessary for replacing the used submerged nozzle 47 with the new submerged nozzle 47, particularly, the duration of interruption of the molten metal pouring operation, is very short; consequently, the scrapping of a machine stop slab in the molten metal can be limited to the least extent and the yield can be increased.

The operation for setting the new submerged nozzle 47 on and removing the used submerged nozzle 47 from the guide arm unit 44 need not necessarily be carried out by manual work, but may be carried out by automatic operation, which reduces manual work in a very hot, harsh environment.

The positioning projections 54 formed on the tongues 53 of the nozzle case 48 fitted on the submerged nozzle 47, and the positioning recesses 55 formed in the lower surfaces of the guide grooves 46 of the guide rails 45 of the guide arm unit 44 to receive the positioning projections 54 therein ensures correct positioning of the new submerged nozzle 47 at the nozzle setting position.

Since the nozzle case 48 has a simple construction capable of being fitted on the upper part of the submerged nozzle 47, the nozzle case 48 can be fabricated at low cost, and the running cost can be reduced. Further, the upper end surface of the submerged nozzle 47 will not be deformed when the upper end of the submerged nozzle 47 held by the nozzle case 48 that is supported at the tongues 53 on the guide rails 45 is pressed against the lower end surface of the chute nozzle 41, and the joint between the submerged nozzle 47 and the chute nozzle 41 can be sealed satisfactorily, so that abnormal erosion does not occur, and the deterioration of the quality of the steel can be prevented. Since the positions of the outlet openings **47*b* relative to the support pins 52 are determined by the positioning means, the directions of the outlet openings 47*b* are not deviated from correct positions when the submerged nozzle 47 is inserted in the mold, and the submerged nozzle 47 will not be moved relative to the nozzle case 48 by a buoyancy that acts on the submerged nozzle 47** when the same is inserted in the mold.

Since the nozzle changing cylinder actuator 56 can be retracted or removed from the working position, the operation for setting the new submerged nozzle 47 on the guide arm unit 44 is not obstructed by the nozzle changing cylinder actuator 56 and the new submerged nozzle 47 can be easily set on the guide arm unit 44. The stoppers 61 disposed at positions near the ejecting end of the guide rails 45 in the guide grooves of the guide rails 45 eliminates the danger of the used submerged nozzle 47 from slipping out of the guide arm unit during the submerged nozzle changing operation, which enhances safety.

When the nozzle guide 70 and the nozzle handling tool 80 are used, the new submerged nozzle 47 need not be handled directly by hand when setting the new submerged nozzle 47 on the guide arm unit 44, the new submerged nozzle 47 can be handled from a remote position by a reduced force, and the new submerged nozzle can be easily set on the guide arm unit 44. When a nozzle guide similar to the nozzle guide 70 is disposed near the ejecting end of the guide arm unit 44, the work for removing the used submerged nozzle can be facilitated.

INDUSTRIAL APPLICABILITY

The submerged nozzle changing apparatus is suitable for use for changing the submerged nozzle for taking out a molten metal from a molten metal container in a continuous casting installation.

We claim:

1. A submerged nozzle changing apparatus comprising:

a submerged nozzle holding cylinder actuator (42) fixedly provided below a slide valve device (32) provided at a bottom of a molten metal container (30) for controlling flow rate of a molten metal, said cylinder actuator (42) having a piston rod (43) movable vertically with respect to the slide valve device;

a guide arm unit (44) fixedly mounted to said piston rod (43) for vertical movement with the piston rod and having a pair of a parallel horizontal guide rails (45) provided in oppositely facing inner surfaces thereof with horizontal guide grooves (46) having open opposite ends, said guide grooves (46) being adapted to receive, in slidable engagement therein, tongues (53) provided on a nozzle case (48) fitted on an upper portion of a submerged nozzle (47) respectively, said guide grooves (46) having a length for holding at least three nozzle cases; and a nozzle changing cylinder actuator (56) having a pressing member (60) movable horizontally into and out of said guide arm unit (44) for abutting and shifting the submerged nozzle with said tongues (53) in engagement in said guide grooves (46), along the guide grooves to a nozzle setting position immediately under a molten metal pouring opening of said slide valve device (32), said cylinder actuator (42) being operable to move said piston rod (43) and hence said guide rails (45) upwardly, to thereby move the submerged nozzle (47) in said nozzle setting position upwardly so as to press an upper end of said nozzle closely against a bottom of said slide valve device (32), said pressing member (60) being also movable to shift the submerged nozzle, after said piston rod (43) and hence said guide arm unit (44) are moved downward, from said nozzle setting position to a position away from the nozzle setting position.

2. A submerged nozzle changing apparatus according to claim 1, wherein the nozzle case fitted on the submerged nozzle is provided on portions thereof fitted in the guide grooves with positioning projections, respectively, and positioning recesses are formed in surfaces defining the guide grooves of the guide rails for receiving the projections of the nozzle case, respectively, to position the submerged nozzle at the nozzle setting position.

3. A submerged nozzle changing apparatus according to claim 1, wherein the nozzle changing cylinder actuator is capable of being retracted from a working position where the nozzle changing cylinder actuator is able to move a submerged nozzle to the nozzle setting position to a standby position where the nozzle changing cylinder actuator does not obstruct an operation for supplying a new submerged nozzle.

4. A submerged nozzle changing apparatus according to claim 1, wherein the nozzle changing cylinder actuator is supported detachably.

5. A submerged nozzle changing apparatus according to claim 1, wherein the guide rails have one ends through which a new submerged nozzle is introduced and other ends through which a used submerged nozzle is ejected, and said guide rails are provided at said other ends with stoppers for preventing the used submerged nozzle from slipping off the guide rails.

6. A submerged nozzle changing apparatus according to claim 1, further comprising a nozzle guide detachably supported on the molten metal container or the slide valve device, provided with a mounting plate capable of supporting a submerged nozzle on one side of the molten metal container at a nozzle mounting position and of guiding the submerged nozzle onto the guide arm unit.

7. A submerged nozzle changing apparatus according to claim 6, wherein the nozzle guide is provided with a rail, the nozzle guide is used for guiding a submerged nozzle in combination with a nozzle handling tool comprising a shaft, a support head attached to one end of the shaft and having a bifurcate support arm capable of being engaged with the lower part of the nozzle case fitted on the submerged nozzle, and a wheel supported on the support head at a position near the base end of the bifurcate support arm so as to be able to roll along the rail.

8. A submerged nozzle changing apparatus according to claim 1, further comprising a fixing means for fixing a nozzle case to a submerged nozzle, and a positioning means for determining the respective positions of the outlet openings of the submerged nozzle.

* * * * *